US007626180B2

(12) United States Patent
Osada et al.

(10) Patent No.: US 7,626,180 B2
(45) Date of Patent: Dec. 1, 2009

(54) CHARGED PARTICLE BEAM APPARATUS, METHOD FOR CONTROLLING CHARGED PARTICLE, AND FREQUENCY ADJUSTMENT APPARATUS

(75) Inventors: Yusuke Osada, Kanagawa (JP); Tadahisa Shiono, Kanagawa (JP); Yutaka Yabe, Kanagawa (JP); Makoto Ito, Kanagawa (JP)

(73) Assignee: Showa Shinku Co., Ltd., Kanagawa (JP)

( * ) Notice: Subject to any disclaimer, the term of this patent is extended or adjusted under 35 U.S.C. 154(b) by 120 days.

(21) Appl. No.: 11/946,170

(22) Filed: Nov. 28, 2007

(65) Prior Publication Data

US 2008/0164820 A1 Jul. 10, 2008

(30) Foreign Application Priority Data

Nov. 28, 2006 (JP) ..... 2006-320764

(51) Int. Cl.
*H01J 27/00* (2006.01)

(52) U.S. Cl. ..... 250/423 R; 250/424; 250/426; 250/396 R; 250/398; 315/501; 315/500; 315/400

(58) Field of Classification Search ..... 315/501, 315/500, 505, 506; 250/396 R, 398, 400, 250/396 ML, 423 R, 424, 426
See application file for complete search history.

(56) References Cited

U.S. PATENT DOCUMENTS 6,724,160 B2 * 4/2004 Kaufman et al. ..... 315/500

FOREIGN PATENT DOCUMENTS

JP 2000323442 11/2000
JP 2003298374 10/2003

* cited by examiner

*Primary Examiner*—Tuyet Vo
(74) *Attorney, Agent, or Firm*—Howard & Howard Attorneys PLLC

(57) ABSTRACT

An ion gun 11 supplies an Ar gas into a main body 111 from a gas inlet 114, causes DC hot cathode discharge between a filament 113 and an anode 112 to generate Ar plasma. Next, a voltage gradient is applied to separated accelerator grids 116*a*, 116*b* having a bi-separated configuration in an ion ejecting direction. The each potential of the separated accelerator grids 116*a*, 116*b* is independently controlled by independently setting accelerator control switches 121*a*, 121*b* on or off to change the potential of that of the separated accelerator grids 116*a*, 116*b* which corresponds to an ion beam to be disabled.

14 Claims, 18 Drawing Sheets

PRIOR ART

PRIOR ART

PRIOR ART

PRIOR ART

CHARGED PARTICLE BEAM APPARATUS, METHOD FOR CONTROLLING CHARGED PARTICLE, AND FREQUENCY ADJUSTMENT APPARATUS

BACKGROUND OF THE INVENTION

1. Field of the Invention

The present invention relates to a charged particle beam apparatus which irradiates charged particles like ions, a method for controlling charged particles, and a frequency adjustment apparatus. Particularly, the present invention relates to a charged particle beam apparatus, a method for controlling charged particles, and a frequency adjustment apparatus, which are capable of independently controlling a plurality of charged particle beams.

2. Description of the Related Art

The resonance frequency of a crystal resonator which is a typical piezoelectric device is determined by the thickness of a crystal piece and the film thickness of a metal electrode formed on the top surface thereof. Conventionally, to acquire a desired resonance frequency of a crystal resonator, processes of i) cutting out a crystal piece to a specified thickness, ii) polishing the top surface thereof, and forming a metal film electrode to be a base on the top surface by sputtering deposition or the like, and iii) adjusting the thickness of the metal electrode film while measuring the resonance frequency are performed. As a method of adjusting the thickness of a metal electrode film, there is a method known which irradiates an ion beam from an ion gun to etch the metal electrode film to make the metal electrode film thinner. The ion-beam-etching based frequency adjusting scheme is disclosed in, for example, Unexamined Japanese Patent Application KOKAI Publication No. 2000-323442 and Unexamined Japanese Patent Application KOKAI Publication No. 2003-298374.

A conventional ion gun for frequency adjustment comprises a main body 811, an node 812, a filament 813, a gas inlet 814, a screen grid 815, an accelerator grid 816 and a plurality of DC power supplies, as shown in FIG. 12.

With such a configuration, an Ar gas, for example, as a discharge gas is supplied into the main body 811 from the gas inlet 814, the filament 813 is energized to be heated so that Ar plasma is generated by DC hot cathode discharge between the filament 813 and the anode 812, a high voltage is applied to the accelerator grid 816 from a high-voltage power supply to generate a voltage gradient in a direction of accelerating ions, and positive Ar ions are ejected as an ion beam which is irradiated to a crystal resonator 821 mounted on a mount table 822.

The screen grid 815 and the accelerator grid 816 have pluralities of apertures (draw ports).

When a group of apertures is formed in a pattern as shown in FIG. 13, a single ion beam having an ion current density distribution which is most intense at the center and gradually becomes weaker toward a periphery as shown in FIG. 14 is formed. FIG. 14 shows the ion current density at the position of a substrate to be etched, and represents a distance from a position facing the center of the ion gun as an origin.

Recently, to reduce the space of the apparatus and shorten the process time, a plurality of crystal resonators are processed by irradiating a plurality of ion beams having an ion current density distribution as shown in FIG. 17 to a plurality of piezoelectric devices from a single ion gun. FIG. 17 shows the ion current density at the position of a substrate to be etched, and represents a distance from a position facing the center of the ion gun as an origin.

As shown in FIG. 15, the basic configuration of the ion gun which irradiates a plurality of ion beams is identical to that of the single-ion-beam ion gun shown in FIG. 12. It is to be noted however that as shown in FIG. 16, the screen grid 815 and the accelerator grid 816 in which plural groups of apertures (two in the diagram) are formed are disposed to generate a plurality of ion beams.

SUMMARY OF THE INVENTION

The time needed for frequency adjustment is determined by the deviation of the frequency of a crystal resonator from a target frequency and varies from one crystal resonator 821 to be adjusted from another. To adjust two crystal resonators 821 in parallel, therefore, frequency adjustment is terminated at separate timings. It is therefore necessary to prevent the beam from hitting the crystal resonator 821 whose frequency adjustment has been finished. Conventionally, however, it is not possible to perform such control as to disable only one ion beam. Therefore, mechanical shutters 823 are disposed to block the ion beams to the crystal resonators 821 whose adjustment has been finished.

With such a configuration, however, the mechanical shutters 823 are sputtered with the blocked ion beams, and worn off. Particles of the mechanical shutters 823 are deposited in the vacuum chamber. Thus requiring a work of regularly replacement thereof and a work of removing the particles. This is troublesome to an operator.

Adhesion of particles floating in the chamber to a device degrades the quality of the crystal resonator.

A similar problem commonly arises when a process target is worked using a plurality of charged particle beams as well as when the metal electrode of the crystal resonator is polished with an ion beam.

According to the conventional configuration, the intensities of a plurality of ion beams are common, making it difficult to achieve a variation of works.

The present invention has been made in view of the foregoing situations, and it is an object of the present invention to ensure independent control of a plurality of charged particle beams.

It is another object of the present invention to provide a charged particle beam apparatus which is easy to operate and maintain.

To achieve the objects, according to a first aspect of the invention, there is provided a charged particle beam apparatus for irradiating charged particles, comprising:

charged particle generating means that generates charged particles;

an accelerator grid having multi-separated accelerator grids that draw the charged particles generated by the charged particle generating means and output charged particle beams;

a screen grid provided between the charged particle generating means and the accelerator grid; and control means that controls each potential of the multi-separated accelerator grids to thereby independently control the respective charged particle beams.

To achieve the objects, according to a second aspect of the invention, there is provided a frequency adjustment apparatus, comprising:

an ion gun comprising the charged particle beam apparatus as recited in claim 1;

arrangement means that disposes a plurality of piezoelectric devices; and resonance frequency discrimination means that discriminates resonance frequencies of a plurality of piezoelectric devices disposed by the arrangement means, whereby while the resonance frequencies of the plurality of piezoelectric devices disposed by the arrangement means are monitored, an ion beam is irradiated to the plurality of piezoelectric devices to etch at least a part of each piezoelectric device, thereby adjusting the resonance frequencies of the plurality of piezoelectric devices.

To achieve the objects, according to a third aspect of the invention, there is provided a charged particle beam apparatus comprising:

generating plasma in a predetermined container;

disposing a plurality of accelerator grids adjacent to the plasma;

applying a voltage to each accelerator grid to form a voltage gradient in a direction of drawing charged particles, and ejecting the charged particles in the plasma; and independently controlling voltages to the plurality of accelerator grids to thereby control a current density distribution of the ejected charged particles.

DETAILED DESCRIPTION OF THE PREFERRED EMBODIMENTS

A charged particle beam apparatus according to each embodiment of the present invention as adapted to a frequency adjustment apparatus which adjusts the resonance frequency by etching the metal electrode of a crystal resonator will be described below by way of example.

First Embodiment

Figure 1:
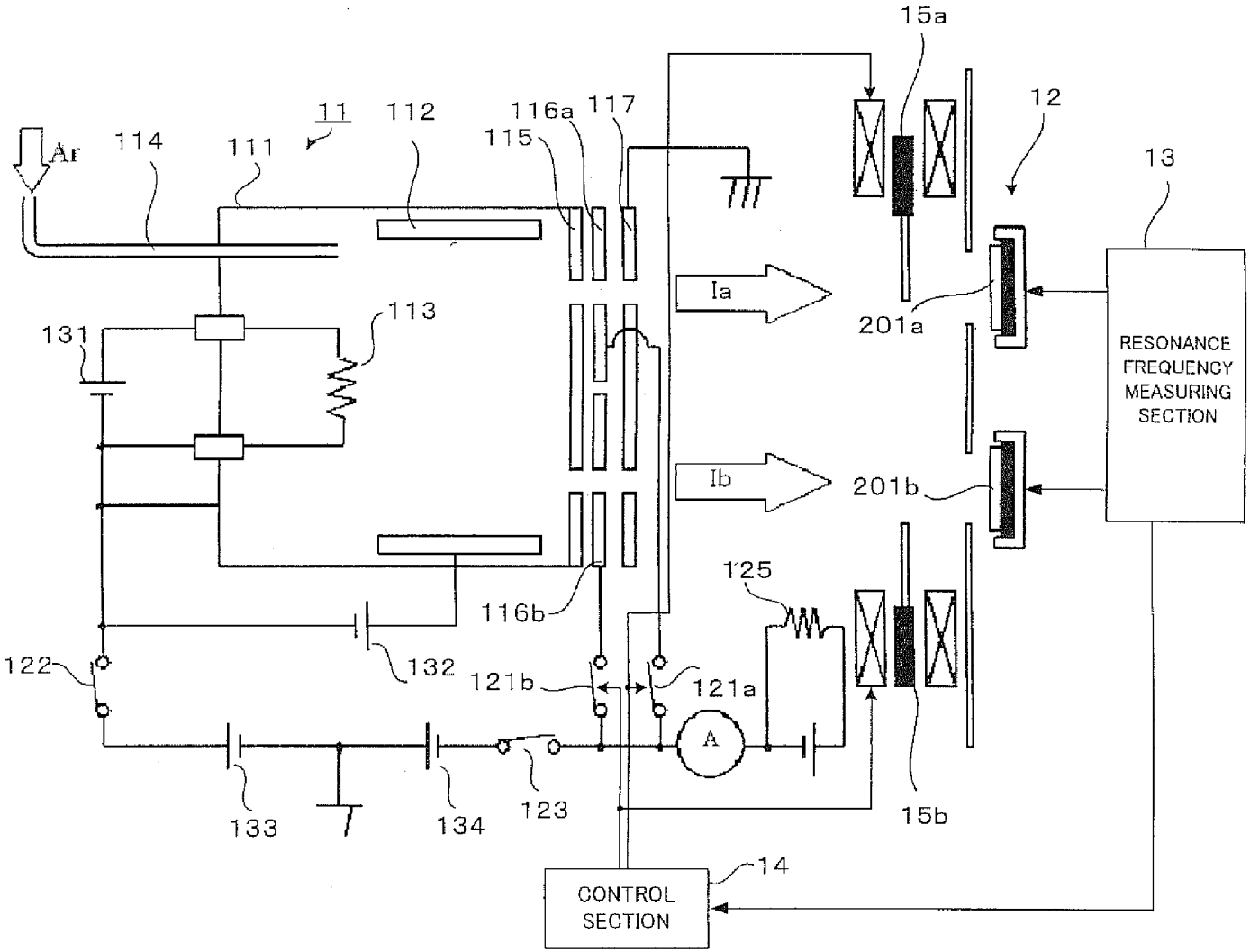
FIG. 1 is a diagram of the general configuration of a frequency adjustment apparatus according to a first embodiment of the present invention.
Figure 2:
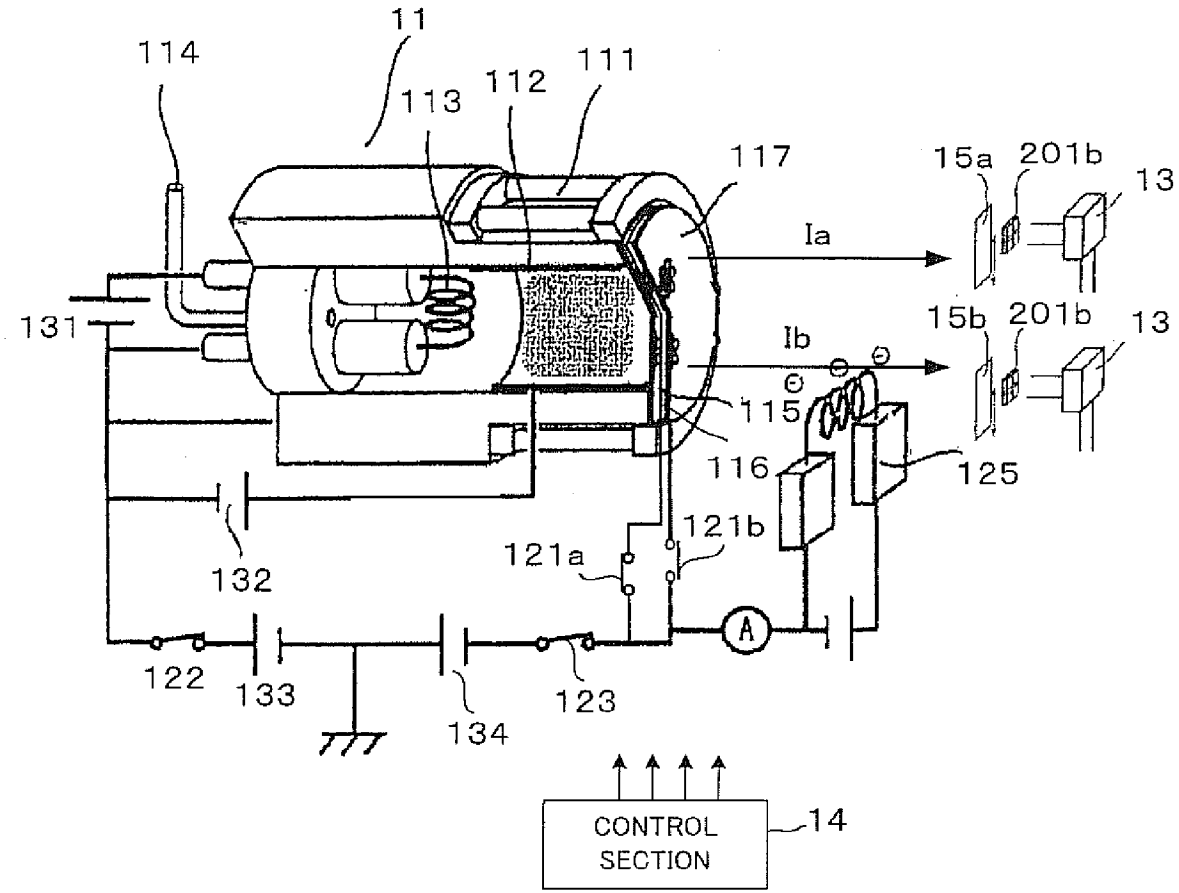
FIG. 2 is an exploded perspective view of the frequency adjustment apparatus shown in FIG. 1.

A frequency adjustment apparatus according to a first embodiment of the present invention is shown in FIGS. 1 and 2. As illustrated, the frequency adjustment apparatus comprises an ion gun 11, a mount table 12 on which a crystal resonator to be worked is mounted, a resonance frequency measuring section 13 which detects the resonance frequency of a crystal resonator, a control section 14 and a shutter 15.

The ion gun 11 is a device which generates two ion beams Ia and Ib, and includes a main body (chamber) 111, an anode (electrode) 112, a filament 113, a gas inlet 114, a screen grid 115, an accelerator grid 116 (116*a*, 116*b*), a decelerator grid 117, a filament power supply 131, a discharge power supply 132, a beam supply 133, an accelerator power supply 134, a neutralizer 125, accelerator control switches 121*a*, 121*b*, and beam switches 122, 123.

The main body 111 comprises a cylindrical metal casing with a coated surface, and defines process space. The main body 111 is kept at the same potential as that of the negative pole of the filament power supply 131.

The anode 112, disposed close to side walls of the main body 111 in a cylindrical band form, serves as an anode for DC discharge.

The filament 113 constitutes a hot cathode for DC discharge.

The gas inlet 114 supplies a discharge gas, such as Ar, into the main body 111.

Figure 13:
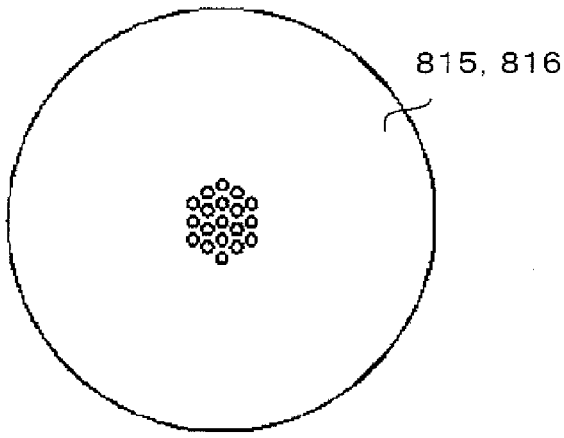
FIG. 13 is a diagram showing an example of the pattern of the accelerator grid used in the apparatus of FIG. 12.
Figure 14:
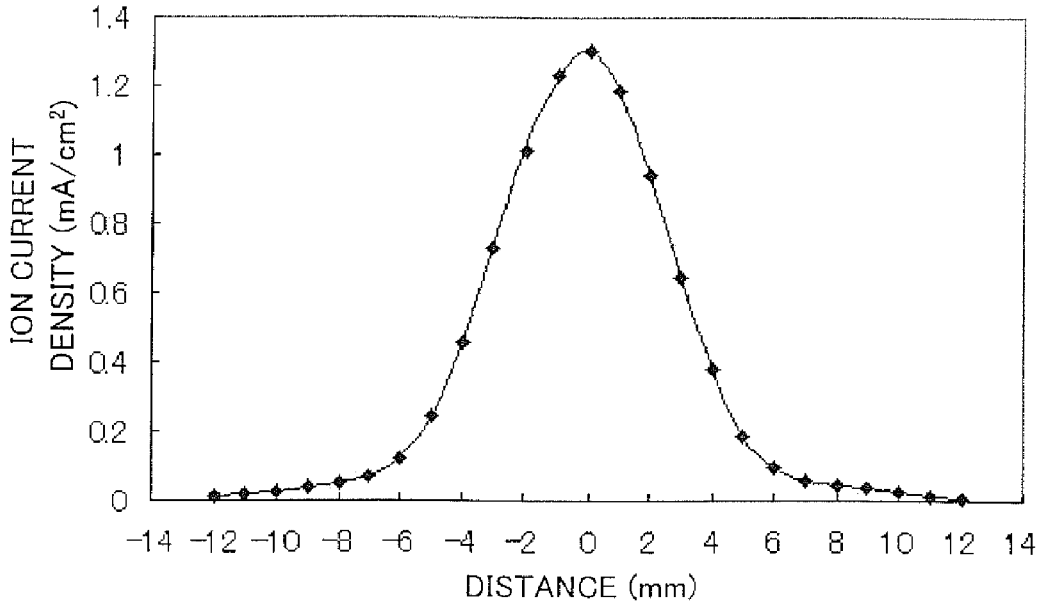
FIG. 14 is a graph showing an example of the current density of an ion beam to be irradiated by the apparatus of FIG. 12.
Figure 15:
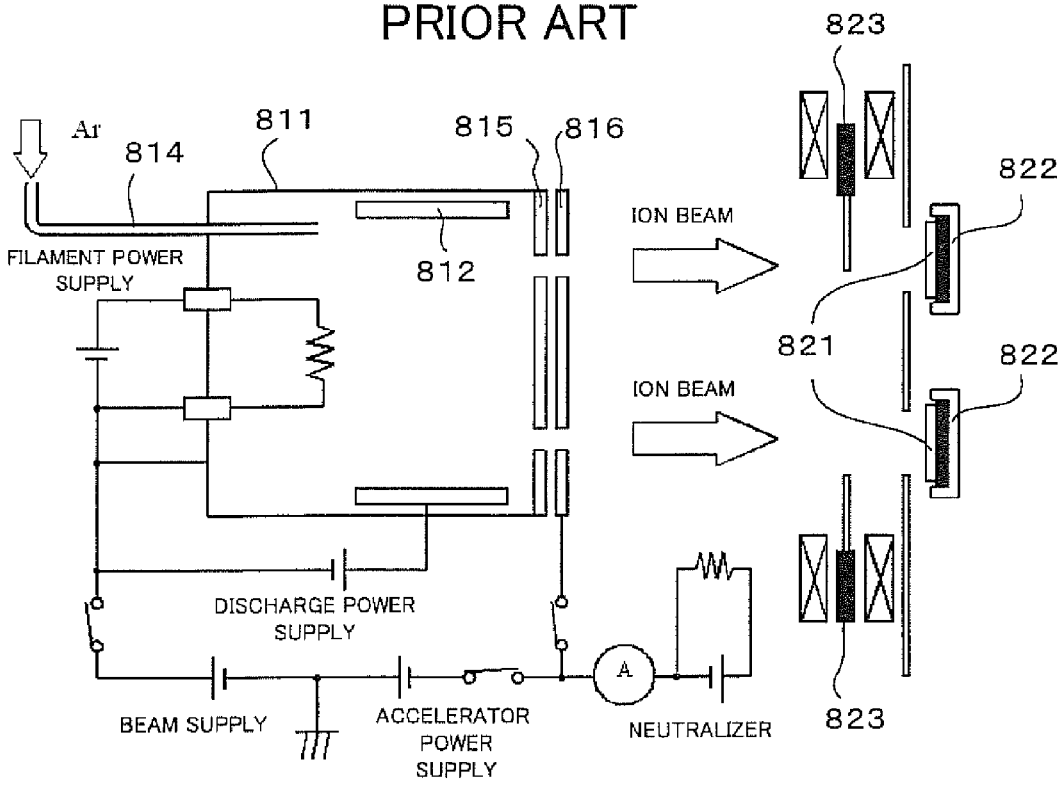
FIG. 15 PRIOR ART
FIG. 15 is a diagram showing an example of the configuration of a conventional 2-beam type frequency adjustment apparatus.
Figure 16:
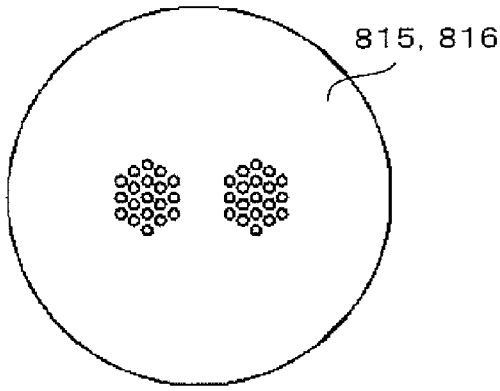
FIG. 16 is a diagram showing an example of the pattern of a screen grid and accelerator grid used in the apparatus of FIG. 15.
Figure 17:
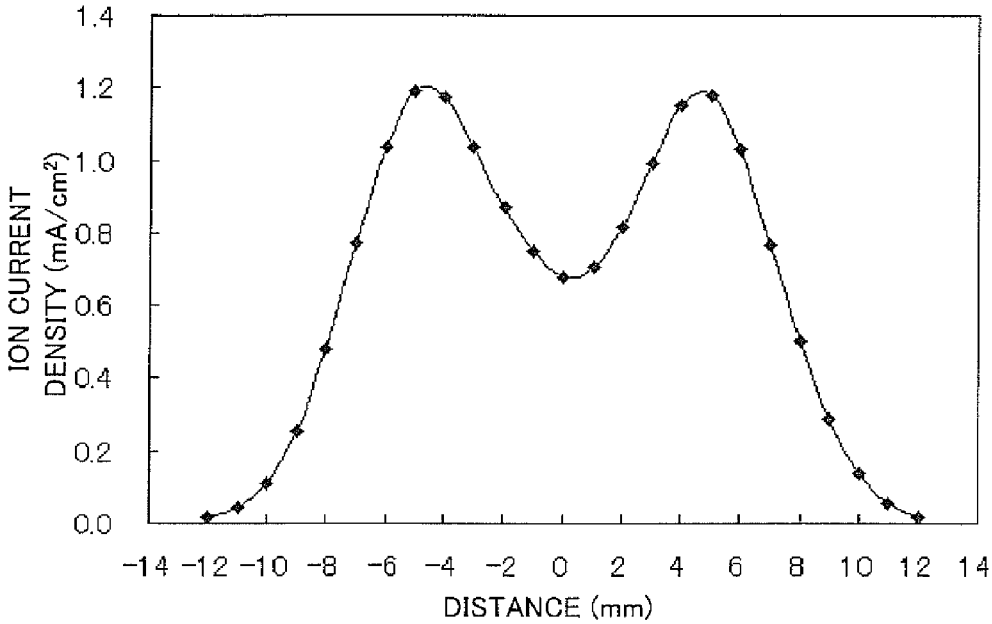
FIG. 17 is a graph showing an example of the current density of an ion beam to be irradiated by the apparatus of FIG. 15.

The screen grid 115, disposed at the ion ejection surface of the main body 111, confines ions in the chamber excluding an aperture (aperture through which ion beam is withdrawn) portion. The ion gun 11 outputs two beams, and its grid pattern has a structure for two beams as shown in FIG. 13A. The grid pattern has such a structure in which two groups 21 of apertures 211 are formed at a distance d.

Figure 3A:
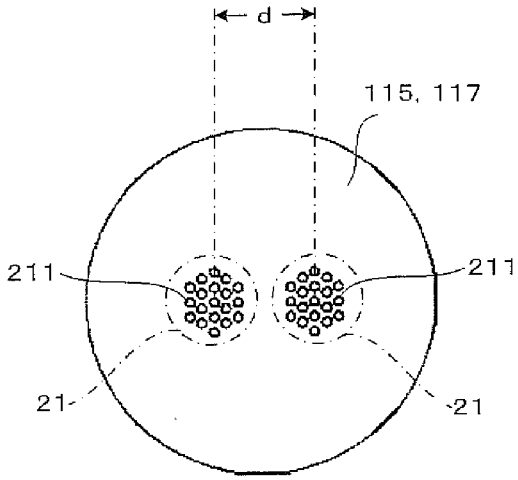
FIGS. 3A to 3C are diagrams showing the structures of grids according to the first embodiment of the present invention.
Figure 3B:
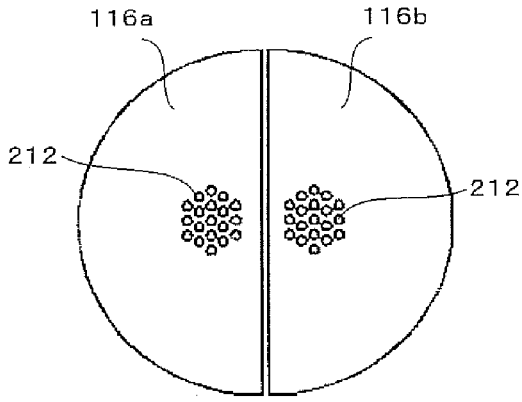

The accelerator grid 116 is disposed at the ion ejection surface of the main body 111. The accelerator grid 116 is substantially in parallel with, and at a predetermined distance from the screen grid 115. The accelerator grid 116 has a shape of a disk separated into two as shown in FIG. 3B. In other words, the accelerator grid 116 has a structure of two semicircular accelerator grids 116*a*, 116*b* combined. Hereinafter, the whole of separated accelerator grids 116*a*, 116*b* is called accelerator grid 116, while the individual semi-circular grids are called separated accelerator grids 116*a*, 116*b*.

As shown in FIG. 3B, apertures 212 are formed in the accelerator grid 116 at positions overlying the apertures 211 formed in the screen grid 115. A group of apertures for outputting one beam is arranged at one separated accelerator grid 116*a*, 116*b*.

The decelerator grid 117 is disposed at the ion ejection surface of the main body 111. The decelerator grid 117 is substantially in parallel with, close to, and apart from the accelerator grid 116. The decelerator grid 117 has the same structure as the screen grid 115 as shown in FIG. 3A. The decelerator grid 117 is connected to the ground. The decelerator grid 117 has a capability of shielding a spatial electric field (electric field in a direction orthogonal to the ion beam) generated between the separated accelerator grid 116*a* and the separated accelerator grid 116*b* by the potential difference between the both separated accelerator grids, and of reducing the interaction between the separated accelerator grids 116*a* and 116*b*.

Figure 3C:
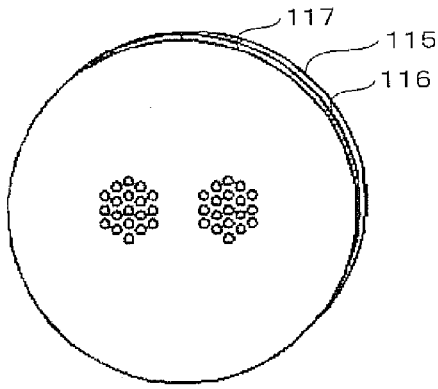

As shown in FIG. 3C, the apertures in the screen grid 115, the accelerator grid 116 and the decelerator grid 117 are formed and arranged in such a way that their positions overlie one another.

In FIGS. 1 and 2, the accelerator control switch 121*a* is connected between the negative pole of the accelerator power supply 134 and the separated accelerator grid 116*a*, and is set on or off by a control signal from the control section 14. The accelerator control switch 121*b* is connected between the negative pole of the accelerator power supply 134 and the separated accelerator grid 116*b*, and is set on or off by a control signal from the control section 14.

The beam switches 122 and 123 apply a potential difference between the anode 112 and the accelerator grid 116.

The filament power supply 131 comprising a DC power supply energizes and heats the filament 113.

The discharge power supply 132 applies a DC voltage for discharge between the anode 112, and the main body 111 and the filament power supply 131.

The beam supply 133 increases the voltage of plasma in the main body 111 at the time of irradiating ion beams.

The accelerator power supply 134 applies a negative voltage to the separated accelerator grids 116*a*, 116*b*.

The neutralizer 125 supplies electrons to the ion beams Ia and Ib to neutralize the charges of the ions to prevent a piezoelectric device from being charged.

The mount table 12 shown in FIG. 1 has two crystal resonators 201*a* and 201*b* to be worked, apart from each other at a given distance.

The resonance frequency measuring section 13, connected to the crystal resonators 201*a* and 201*b* mounted on the mount table 12, measures the resonance frequencies thereof.

The control section 14, which comprises a microprocessor, sequencer or the like, controls the operations of the individual sections. In the embodiment, particularly, the control section 14 performs ON/OFF control of the accelerator control switches 121*a* and 121*b* according to the results of detection from the resonance frequency measuring section 13. The control section 14 also controls the opening/closing of the shutter 15. The configuration may be taken so that control section 14 is installed in the resonance frequency measuring section 13.

The shutter 15 has a shutter 15*a* disposed in front of the crystal resonator 201*a* and a shutter 15*b* disposed in front of the crystal resonator 201*b*, and both shutters respectively shield the ion beams Ia and Ib.

The individual sections shown in FIGS. 1 and 2 are disposed in a vacuum chamber connected to the ground.

Next, the operation of the frequency adjustment apparatus with the above-described configuration will be explained.

First, the crystal resonators 201*a* and 201*b* to be worked are mounted on the mount table 12, and the interior of the vacuum chamber is depressurized.

An Ar gas, for example, as a discharge gas is supplied into the main body 111 from the gas inlet 114, the filament 113 is energized and heated by the filament power supply 131, and a DC voltage is applied between the filament 113 and the anode 112 to cause DC hot cathode discharge, thereby generating Ar plasma.

Subsequently, the beam switches 122 and 123 are set on (at which time the accelerator control switches 121*a* and 121*b* are in an ON state) to apply a high voltage between the anode 112 and the accelerator grid 116. This generates a voltage gradient in a direction of accelerating ions generated by the plasma in the main body 111, so that positive ions of Ar are drawn and are output as the ion beams Ia, Ib from the apertures.

A metal electrode formed on the first crystal resonator 201*a* mounted on the mount table 12 and a metal electrode formed on the second crystal resonator 201*b* mounted thereon are etched by the two irradiated ion beams Ia and Ib to thereby adjust the resonance frequencies of the crystal resonators.

During that time, the resonance frequency measuring section 13 measures the resonance frequencies of the first crystal resonator and the second crystal resonator, and outputs the measuring results to the control section 14.

Figure 4:
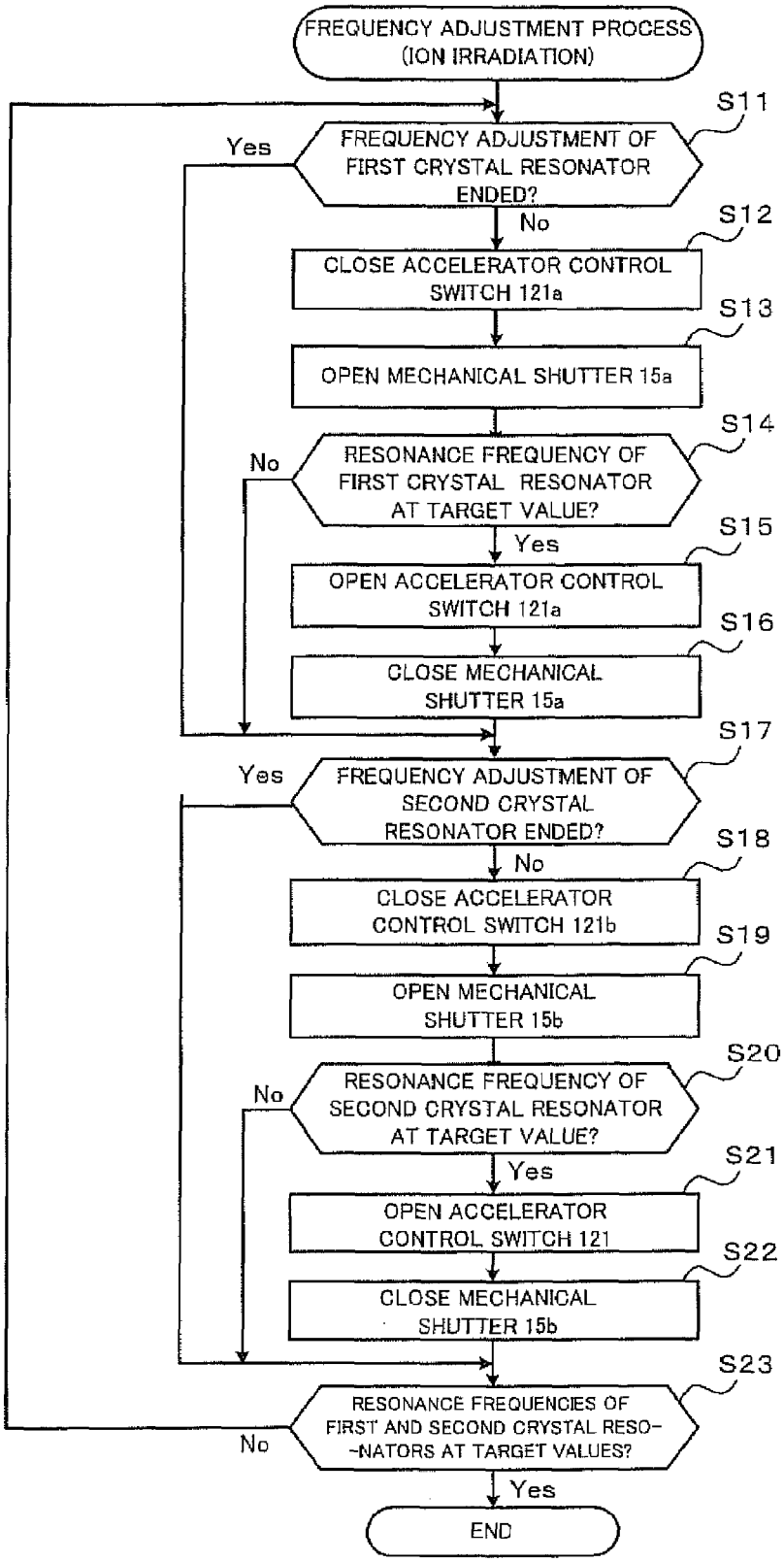
FIG. 4 is a flowchart for explaining the operation of a control section.

After the work process starts, the control section 14 repeats a process illustrated in FIG. 4. While control on the first crystal resonator 201*a* and control on the second crystal resonator 201*b* are carried out in order in FIG. 4 for easier understanding, it is desirable that both controls should be executed in parallel.

First, it is determined whether frequency adjustment on the first crystal resonator 201*a* has been finished (step S11). At the beginning, the accelerator control switch 121*a* is opened and the mechanical shutter 15*a* is closed. When the frequency adjustment has not been finished yet (step S11; NO), the accelerator control switch 121*a* is closed (step S12) and the mechanical shutter 15*a* is opened (step S13) to initiate frequency adjustment on the crystal resonator 201*a*. It is determined whether the resonance frequency of the first crystal resonator 201*a* detected by the resonance frequency measuring section 13 matches with a target frequency (step S14).

When the resonance frequency matches with the target frequency (step S14; Yes), the accelerator control switch 121*a* is opened (step S15). Opening the accelerator control switch 121*a* sets the separated accelerator grid 116*a* in an electrically floating state. This makes the ion beam Ia irradiated from the separated accelerator grid 116*a* very weak while hardly affecting the intensity of the ion beam Ib irradiated from the separated accelerator grid 116*b*.

Further, a solenoid is driven to close the shutter 15*a* to completely block irradiation of the ion beam Ia to the first crystal resonator 201*a* (step S16).

When it is determined in step S14 that the resonance frequency of the first crystal resonator 201*a* detected by the resonance frequency measuring section 13 does not match with the target frequency (step S14; No), the process is resumed to keep working. When it is determined in step S11 that the frequency adjustment process on the first crystal resonator 201*a* has been finished (step S11; Yes), steps S12 to S16 are skipped.

Next, the control section 14 determines whether frequency adjustment on the second crystal resonator 201*b* has been finished (step S17). At the beginning, the accelerator control switch 121*b* is opened and the mechanical shutter 15*b* is closed. When the frequency adjustment has not been finished yet (step S17; NO), the accelerator control switch 121*b* is closed (step S18) and the mechanical shutter 15*b* is opened (step S19) to initiate frequency adjustment on the crystal resonator 201*b*. It is determined whether the resonance frequency of the second crystal resonator 201*b* detected by the resonance frequency measuring section 13 matches with a target frequency (step S20).

When the resonance frequency matches with the target frequency (step S20; Yes), the accelerator control switch 121*b* is opened (step S21). Opening the accelerator control switch 121*b* sets the separated accelerator grid 116*b* in an electrically floating state. This makes the ion beam Ib irradiated from the separated accelerator grid 116*b* very weak while hardly affecting the intensity of the ion beam Ia irradiated from the separated accelerator grid 116*a*. Further, a solenoid is driven to close the shutter 15*b* to completely block irradiation of the ion beam Ib to the second crystal resonator 201*b* (step S22).

When it is determined in step S20 that the resonance frequency of the second crystal resonator 201*b* detected by the resonance frequency measuring section 13 does not match with the target frequency (step S20; No), the process is resumed to keep working. When it is determined in step S17 that the frequency adjustment process on the second crystal resonator 201*b* has been finished (step S17; Yes), steps S18 to S22 are skipped.

Finally, it is determined whether working on the first crystal resonator 201*a* and working on the second crystal resonator 201*b* have both been finished (step S23); when it has been finished (step S23; Yes), the work process is terminated and the process goes to a load-out process, and when it has not been finished yet (step S23; No), the flow returns to step S11 to continue the metal electrode etching process.

In this manner, the intensities of the ion beams Ia and Ib emitted from the ion gun 11 are controlled by setting the accelerator control switches 121*a*, 121*b* on or off, so that working on each crystal resonator can be finished at the adequate timing.

Next, a detailed description will be given of the point that irradiation of an arbitrary one of the ion beams Ia or Ib can be suppressed by setting the accelerator control switch 121*a*, 121*b*.

Figure 5:
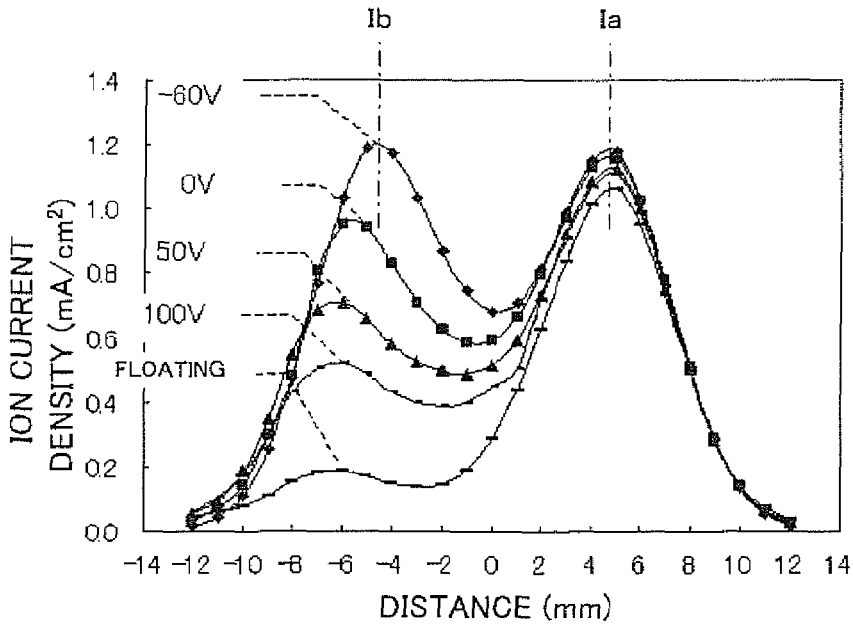
FIG. 5 is a graph showing the relationship between a voltage to be applied to separated accelerator grids and an ion beam intensity.

FIG. 5 shows the current density distributions of the ion beams Ia and Ib under the conditions of the voltage of the beam supply of 300 V and the current of the discharge power supply of 100 mA, acquired by the ion gun 11. In the embodiment, the crystal resonator 201 as a work target is disposed at a position of 25 mm away from the ion beam drawing port, and FIG. 5 shows the current density distributions at the position of 25 mm away from the ion beam drawing port. The abscissa represents the distance from the position facing the center of the ion gun as the origin. This graph represents a change in beam intensity in a case with the potential of one of the two separated accelerator grids 116*a* and 116*b* being set to −20% or so of the beam voltage, i.e., −60 V with respect to the beam voltage of 300 V, the potential of the other one is gradually increased from the accelerator potential of −60 V by a DC stabilized power supply.

It is apparent from FIG. 5 that the peak of one ion beam falls with a change in accelerator potential. Further, in a floating state with disconnection from the DC power supply, the best beam blocking was performed.

That is, it is understood that when the ion gun 11 is controlled to set the separated accelerator grid 116*a* or 116*b* floating, irradiation and blocking of the ion beams Ia and Ib can be controlled independently.

Figure 6:
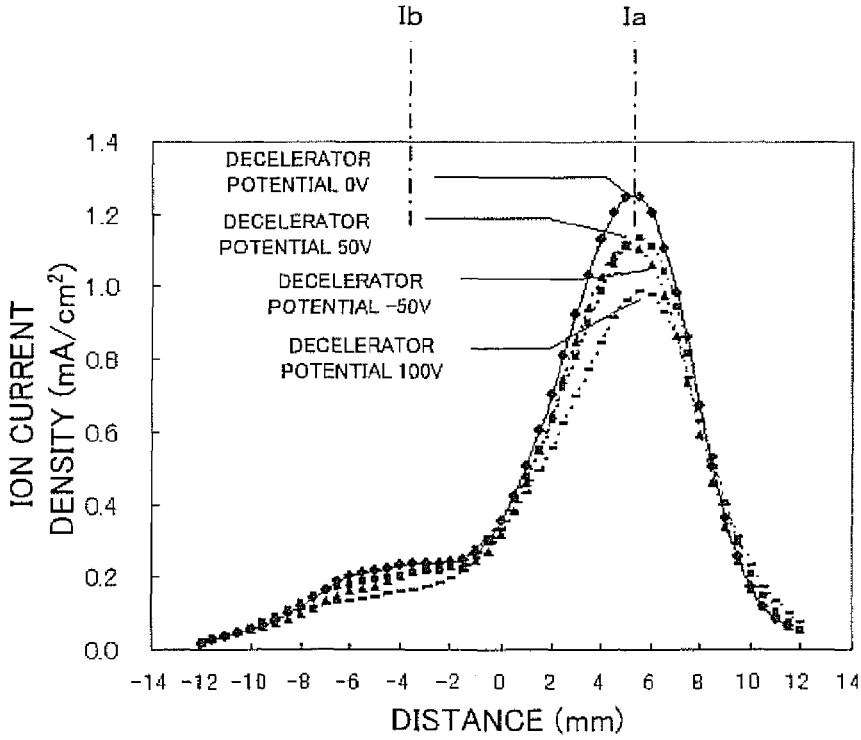
FIG. 6 is a graph showing the relationship between a voltage to be applied to a decelerator grid and an ion beam intensity.

FIG. 6 shows a change in the intensity of an ion beam when the DC stabilized power supply is connected to the decelerator grid 117 under the condition of the voltage of the beam supply of 300 V and the current of the discharge power supply of 100 mA and the potential of the decelerator grid 117 is changed. The ion current density was measured at a position of 25 mm away from the ion beam drawing port. The abscissa in the diagram represents the distance from the position facing the center of the ion gun as the origin. The potential of one separated accelerator grid 116*a* was set to −60 V, and the other separated accelerator grid 116*b* was set floating, i.e., the ion beam Ia was set ON and the ion beam Ib was set Off.

As a result, the peak of the ion current density took a maximum value when the potential was 0 V. The cut-off characteristic of the beam set to OFF does not change. Therefore, it was confirmed that connecting the decelerator grid 117 to the ground could provide a sufficient beam intensity.

Figure 7:
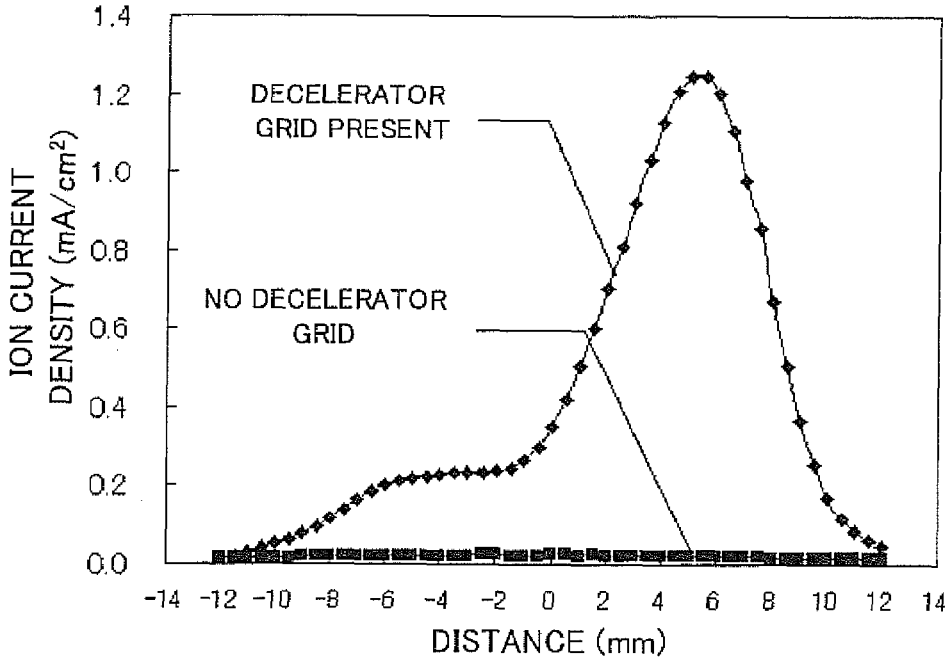
FIG. 7 is a graph showing the relationship between the presence/absence of the decelerator grid and an ion beam intensity.

FIG. 7 shows the ion current densities when the decelerator grid 117 is attached and when it is detached. The ion current density was measured at a position of 25 mm away from the ion beam drawing port. The abscissa in the diagram represents the distance from the position facing the center of the ion gun as the origin. As in FIG. 6, the ion beam Ia was set ON and the ion beam Ib was set Off. As a result, it was confirmed that with the decelerator grid 117 not attached, the linearity of the ion beams Ia, Ib was impaired by an electric field (electric field in a direction orthogonal to the ion beam) at the periphery generated by the potential difference between the two separated accelerator grids 116*a* and 116*b*, so that the ion current density at the position of the crystal resonator 201 as a work target dropped to 1/100 or so, whereas attaching the decelerator grid 117 would relax it to a level of practically raising no problem.

Figure 8:
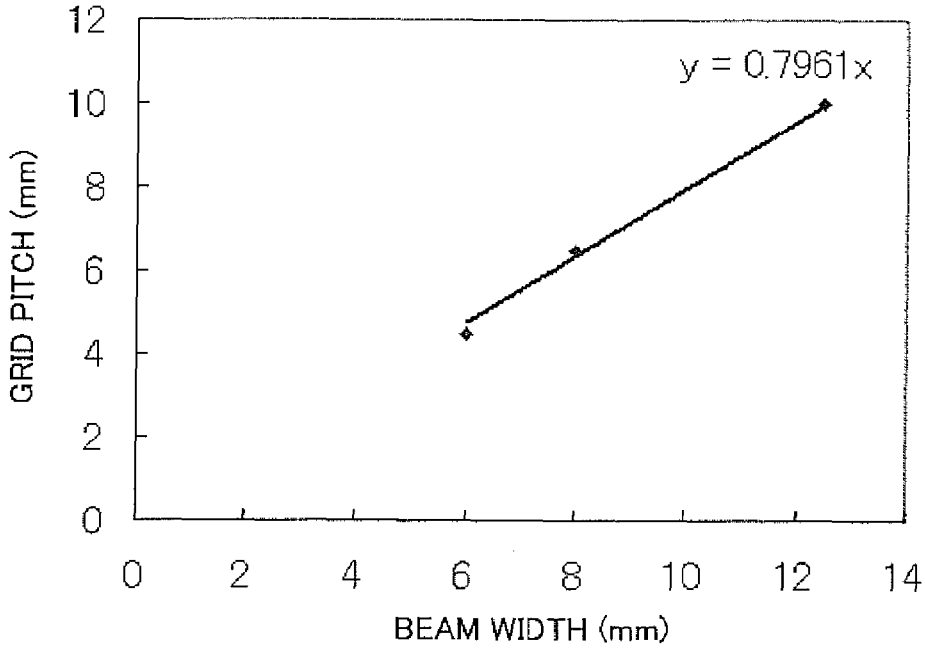
FIG. 8 is a graph showing the relationship between a grid pitch and the width of an ion beam.

Further, in a case of disposing a plurality of groups 21 of apertures, the relationship between the pitch d thereof and the beam width was acquired. FIG. 8 shows the relationship between the pitch of the grid pattern shown in FIG. 3 and the beam width as shown in FIG. 5. As shown in FIG. 8, the pitch d and the beam width can be said to have a linear relationship. It is easy to express the relationship between the pitch and the beam width in this form; while the relationship between the beam width and the pitch is changed by the angle of divergence of the ion gun plasma, the optimal pitch takes a value of 0.5 to 1 times the desired beam width.

As described above, the frequency adjustment apparatus according to the embodiment can work on a plurality of crystal resonators 201*a*, 201*b* in parallel by irradiating a plurality of ion beams from the ion gun 11. The ion beam Ia, Ib irradiated to the crystal resonator 201*a*, 201*b* work (adjustment) on which has been finished earlier can be set OFF independently. This makes it possible to reduce wear-off of the shutters 15*a*, 15*b*, so that generation of particles can be reduced.

Further, an ion beam having the adequate width can be acquired by setting the pitch of the groups 21 of apertures 0.5 to 1 times the required beam width.

Moreover, the shutter 15 need not be made faster in order to acquire a high frequency adjustment precision, and the shutter can employ an air-drive structure, not a solenoid-drive type. In this case, wear-out of the mechanical coupling part of the shutter 15 and heat generated by the solenoid coil are avoided, thus making it possible to simplify the shutter structure and the peripheral cooling structure. This improves the space efficiency of the apparatus so that reducing the space of the apparatus can be expected.

Figure 9:
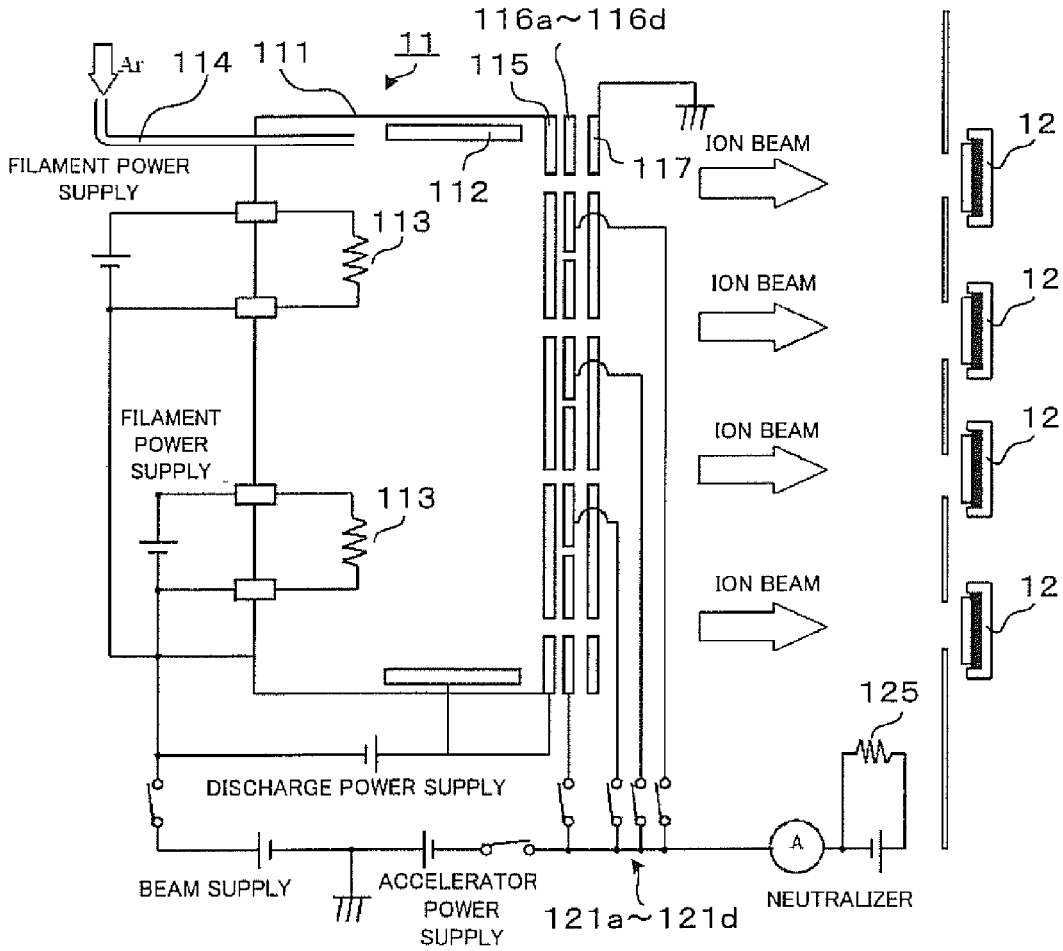
FIG. 9 is a diagram showing an example of the configuration of an apparatus with the number of ion beams being four.

Although the foregoing description of the embodiment has been given of the ion gun 11 which generates and irradiates two ion beams Ia, Ib and the frequency adjustment apparatus which uses the same, the number of ion beams to be emitted by the ion gun is arbitrary. As shown in FIG. 9, for example, the number of beams may be set to four and the number of crystal resonators which are worked simultaneously may be set to four.

In this case, to generate sufficient ions, for example, the number of filaments is increased from that of the structure of FIG. 1, the accelerator grid 116 is divided into, for example, four with a group of apertures being formed in each thereof. Individual separated accelerator grids 116*a* to 116*d* are connected to an accelerator power supply via accelerator control switches 121*a* to 121*d*. This configuration makes it possible to generate four ion beams, work on crystal resonators 201*a* to 201*d* in parallel, and set corresponding accelerator control switches off in order from the ion beam working with which has been finished, thereby disabling irradiation thereof.

Figure 10A:
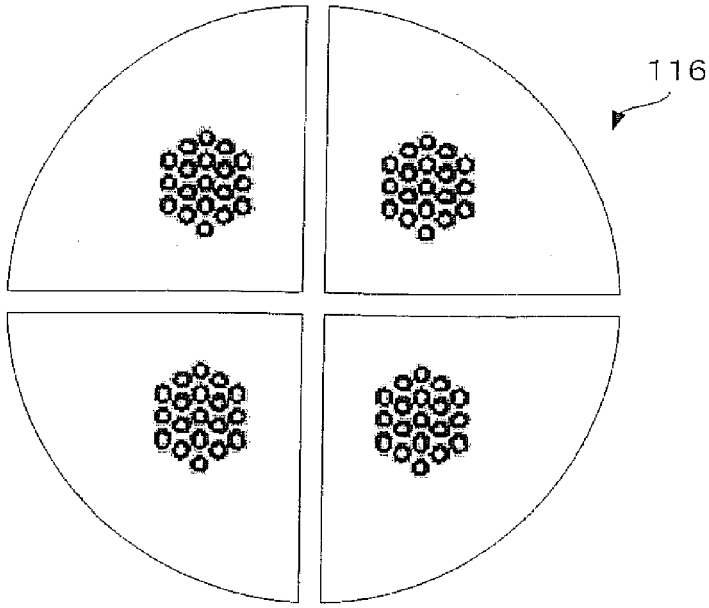
FIGS. 10A to 10C are diagrams showing examples of the pattern of accelerator grids.
Figure 10B:
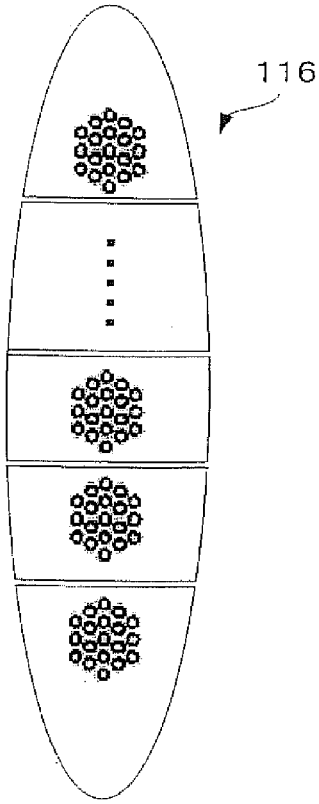
Figure 10C:
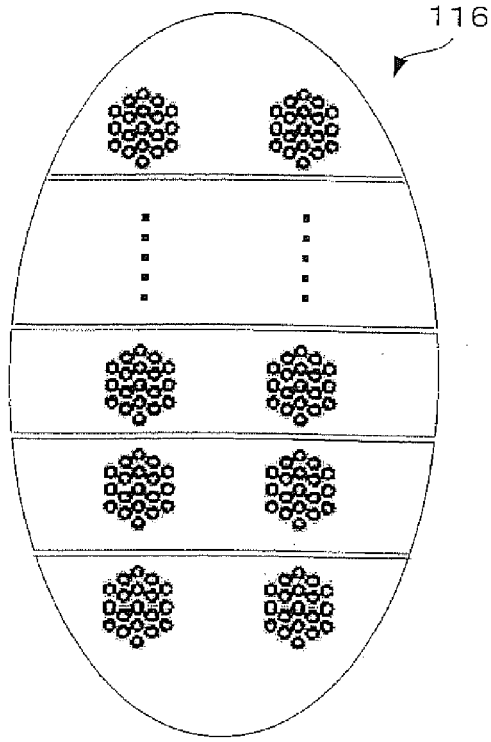
Figure 11:
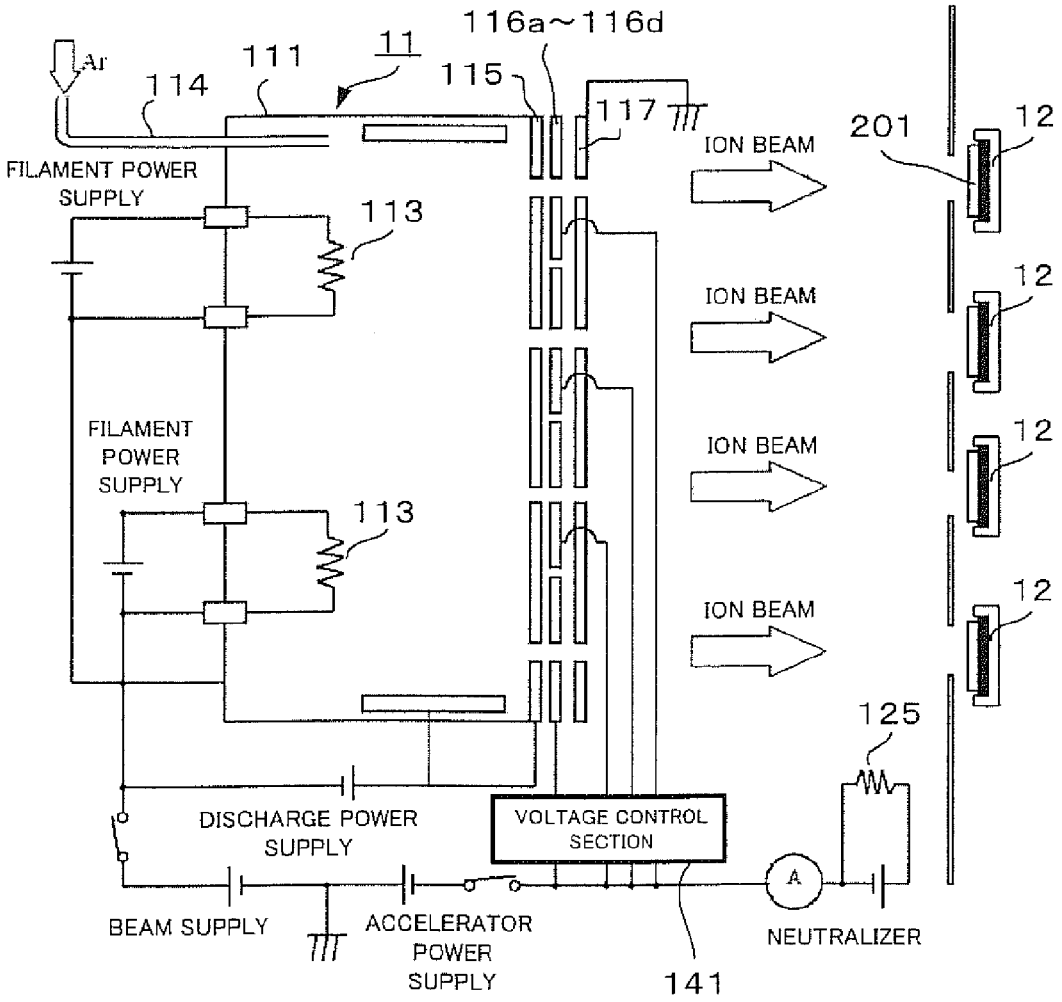
FIG. 11 is a diagram showing an example of the configuration of the apparatus configured to be able to change the intensity of an ion beam.
Figure 12:
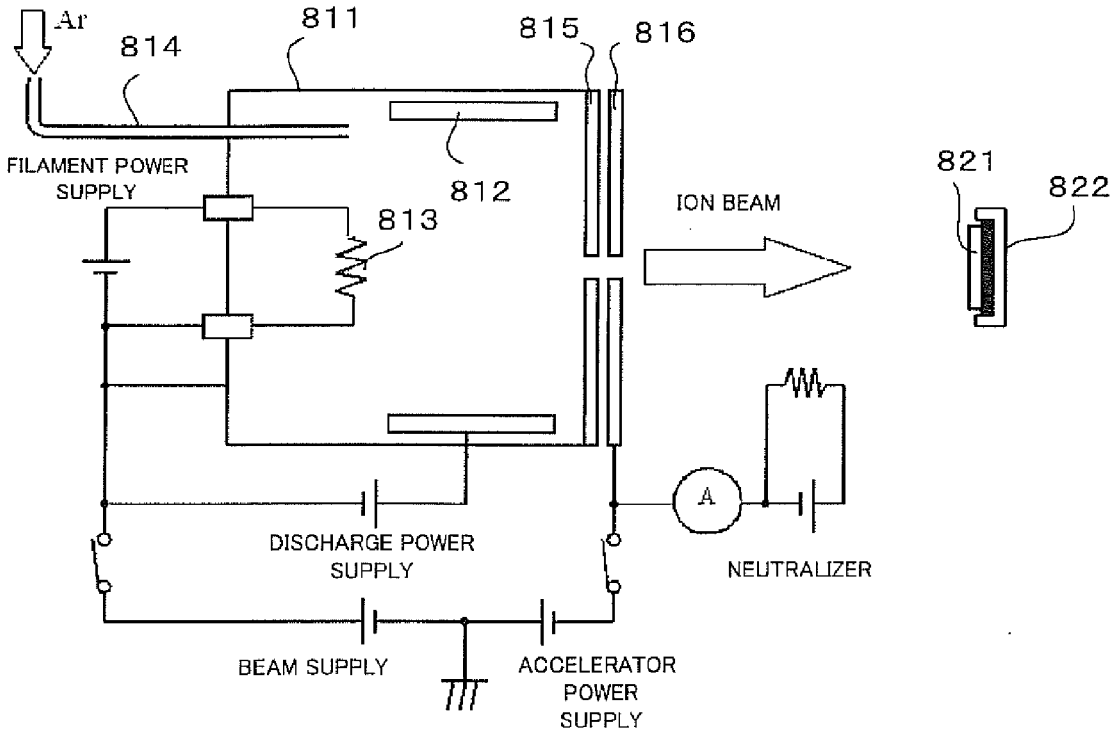
FIG. 12 PRIOR ART
FIG. 12 is a diagram showing an example of the configuration of a conventional 1-beam type frequency adjustment apparatus.

Further, the number of ion beams is not limited to 2, 4, but may be optional or may be an odd number. In those cases, the accelerator grid is divided into an arbitrary pattern as exemplified in FIGS. 10A to 10C.

Although the description of the embodiment has been given of an example where the ion beams are set on or off by setting the voltage applied to the separated accelerator grids on or off (floating), the intensity of each ion beam may be changed continuously or stepwise (as shown in FIGS. 5 and 6) by controlling the voltage applied to each separated accelerator grid. In this case, for example, a voltage control section 141 which applies an arbitrary voltage to each separated accelerator grid may be disposed in place of switches and its output voltage is controlled by a microcomputer or the like. Such a configuration can ensure working with different beam intensities as well as setting ion beams on or off.

When a plurality of devices are simultaneously adjusted with the same ion gun, the frequency adjustment rate can be change device by device.

Second Embodiment

A frequency adjustment apparatus according to a second embodiment of the present invention will be described referring to the diagrams. The frequency adjustment apparatus of the embodiment differs from the apparatus of the first embodiment in that the area of the accelerator grid of the ion gun constituting the frequency adjustment apparatus is made smaller than the area of the screen grid. Same reference numerals are given to those parts which are common to those of the first embodiment hereinafter to omit detailed descriptions thereof.

Figure 18:
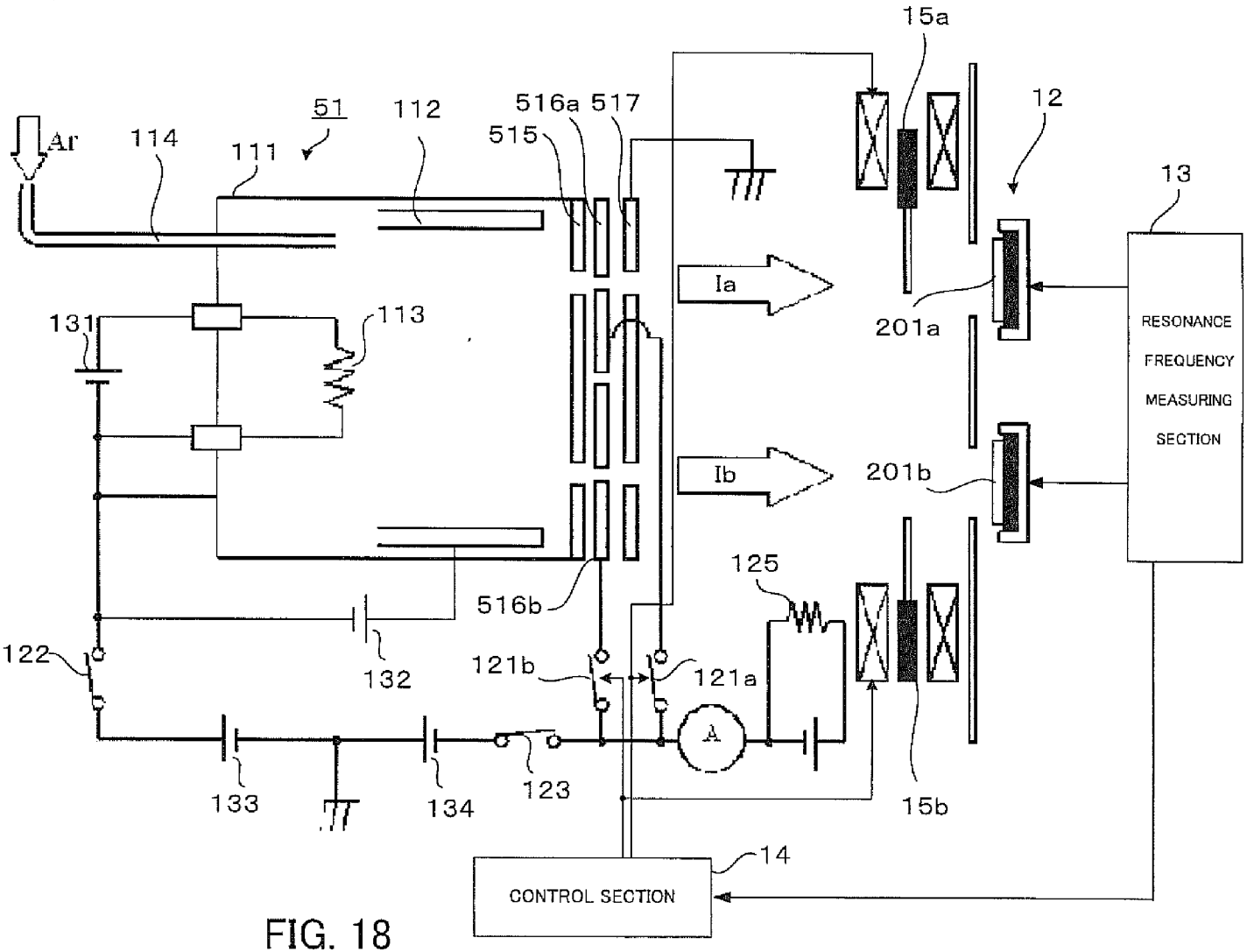
FIG. 18 is a diagram of the general configuration of a frequency adjustment apparatus according to a second embodiment of the present invention.

A configurational example of the frequency adjustment apparatus according to the embodiment is shown in FIG. 18. The frequency adjustment apparatus of the embodiment, like the first embodiment, comprises an ion gun 51, a mount table 12 on which a crystal resonator to be worked is mounted, a resonance frequency measuring section 13 which detects the resonance frequency of a crystal resonator, a control section 14 and a shutter 15.

The ion gun 51 is a device which generates two ion beams Ia and Ib, and includes a main body (chamber) 111, an anode (electrode) 112, a filament 113, a gas inlet 114, a screen grid 515, an accelerator grid 516 (516*a*, 516*b*), a decelerator grid 517, a filament power supply 131, a discharge power supply 132, a beam supply 133, an accelerator power supply 134, a neutralizer 125, accelerator control switches 121*a*, 121*b*, and beam switches 122, 123.

Figure 19A:
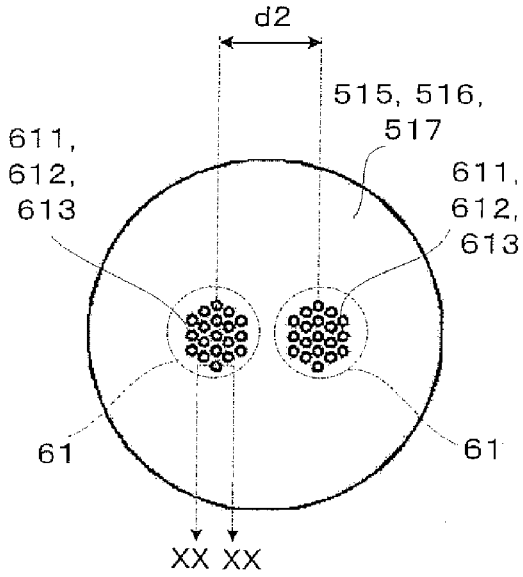
FIGS. 19A to 19C are diagrams showing the structures of grids according to the second embodiment of the present invention.

The screen grid 515, disposed at the ion ejection surface of the main body 111, confines ions in the chamber excluding an aperture (aperture through which ion beam is withdrawn) portion. The ion gun 51 outputs two beams, and its grid pattern has a structure for two beams as shown in FIG. 19A. The grid pattern has such a structure in which two groups 61 of apertures are formed at a distance d2.

Figure 19B:
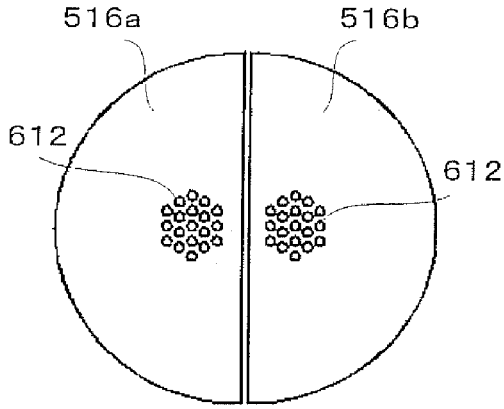
Figure 19C:
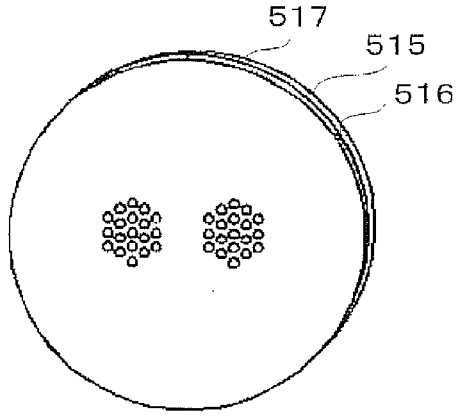

The accelerator grid 516 is disposed at the ion ejection surface of the main body 111. The accelerator grid 516 is substantially in parallel with, close to, and at a predetermined distance from the screen grid 515. The accelerator grid 516 has a shape of a disk separated into two as shown in FIG. 3B. In other words, the accelerator grid 516 has a structure of two semi-circular separated accelerator grids 516*a*, 516*b* combined, as per the first embodiment. As shown in FIG. 19B, apertures 612 are formed in the accelerator grid 516 at positions overlying apertures 611 formed in the screen grid 515. The area of the apertures 612 of the accelerator grid 516 is made smaller than the area of the apertures 611 of the screen grid 515. A group of apertures for outputting one beam is arranged at one separated accelerator grid 516*a*, 516*b*.

The decelerator grid 517 is disposed close to and apart from the ion ejection surface of the main body 111 substantially in parallel thereto. The decelerator grid 517 has the same structure as the screen grid 515 as shown in FIG. 19A. In the embodiment, the area of apertures 613 of the decelerator grid 517 is made approximately the same as the area of the apertures 611 of the screen grid 515. The decelerator grid 517 is connected to the ground. The potential difference between the separated accelerator grid 516*a* and the separated accelerator grid 516*b* has a capability of shielding a spatial electric field generated between both separated accelerator grids (electric field in a direction orthogonal to the ion beam) to reduce the interaction between the separated accelerator grids 516*a* and 516*b*.

Figure 20:
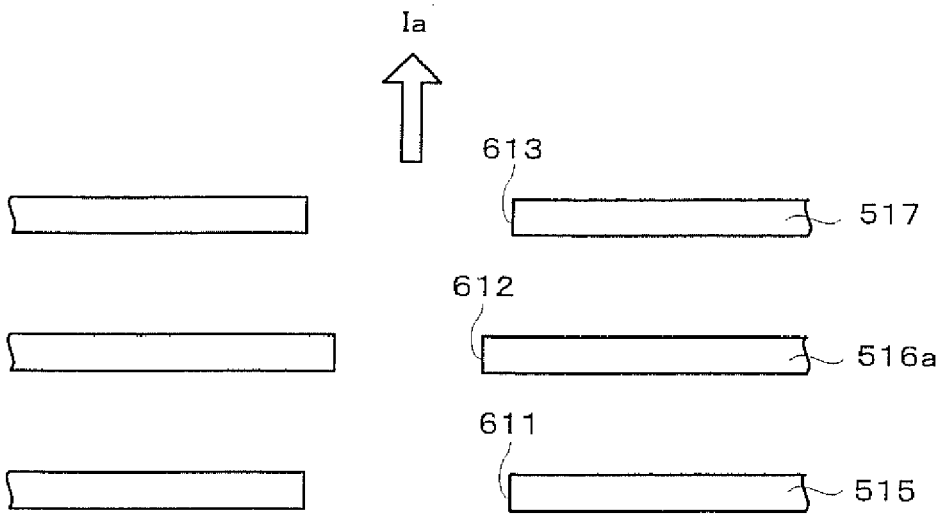
FIG. 20 is a cross-sectional diagram of the grids shown in FIG. 19 along line XX-XX.

In the embodiment, the screen grid 515, the accelerator grid 516 and the decelerator grid 517 are disposed approximately in parallel to one another as shown in FIG. 20. The distance between the screen grid 515 and the accelerator grid 516 is approximately the same as the distance between the accelerator grid 516 and the decelerator grid 517; in the embodiment, specifically, they are disposed at a distance which is substantially the same as the diameter of the aperture. In the embodiment, as shown in FIG. 20, while the area of the apertures 611 provided in the screen grid 515 is made approximately the same as the area of the apertures 613 provided in the decelerator grid 517, the area of the apertures 612 provided in the accelerator grid 516 is made smaller than the area of the apertures 611.

In the embodiment, as will be elaborated below, the area of the apertures 612 of the accelerator grid 516 is made 0.2 to 0.8 times the area of the apertures 611 of the screen grid 515. As the apertures 612 of the accelerator grid 516 are made smaller than the apertures 611 of the screen grid 515, when one of the separated accelerator grids 516*a*, 516*b* is set off, leakage of the beam from the other separated accelerator grid can be suppressed well.

Figure 21:
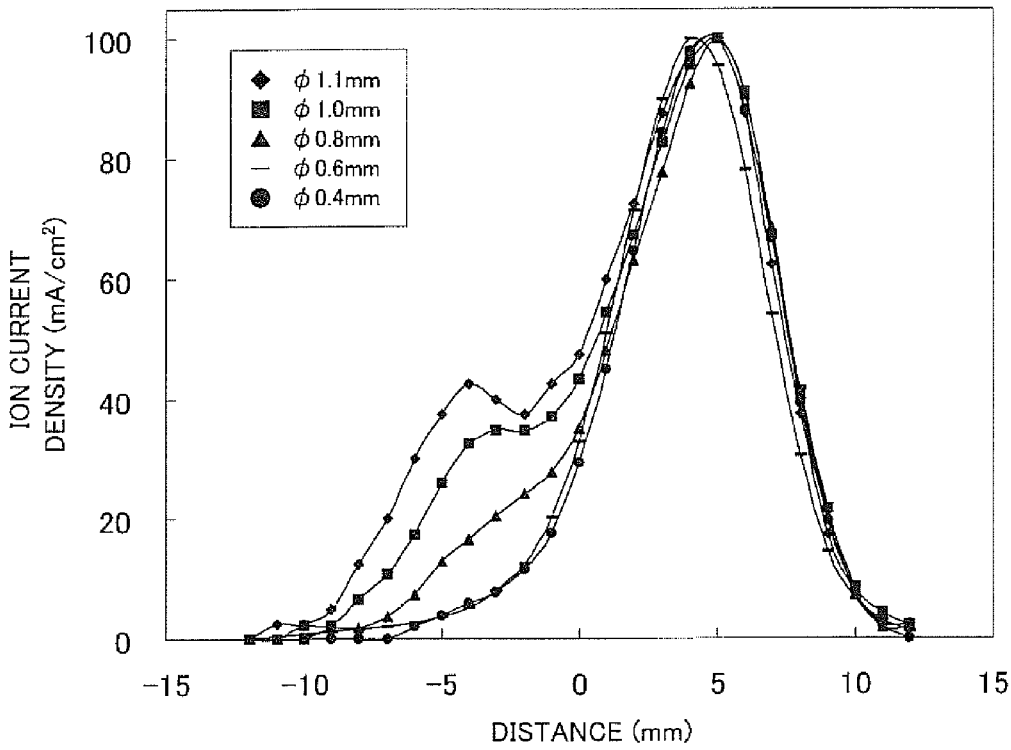
FIG. 21 is a graph showing a change in current density when the diameter of the accelerator grid is changed.

FIG. 21 shows the distribution of the ion current density when the voltage of the beam supply is 900 V, the current of the discharge power supply is 650 mA, the individual apertures 611, 613 of the screen grid 515 and the decelerator grid 517 are set to have a circular shape with a diameter of ϕ1.1 mm, and the individual apertures of the accelerator grids are set to have circular shapes with diameters of ϕ1.1 mm, ϕ1.0 mm, ϕ0.8 mm, ϕ0.6 mm and ϕ0.4 mm. As in FIG. 6, the ion beam Ia was on, and the ion beam Ib was off. The abscissa shown in FIG. 21 represents the distance from the position facing the center of the ion gun as the origin, and the ordinate represents the intensity corresponding to the maximum value of the ion current density distribution, acquired by the aperture diameter of each accelerator grid, by percentage.

When the beam voltage is high as in the above case, owing to an electric field generated by the potential difference between the plasma and the decelerator grid, the ion beam Ib does not become zero completely, producing a leak beam. When the apertures of the accelerator grid and the apertures of the screen grid are the same and have ϕ1.1 mm, as shown in FIG. 21, for example, it is apparent that the ion beam Ib is 40% or so with respect to the ion beam Ia, producing a leak beam. It is however apparent that if the inside diameters of the accelerator grids are reduced to ϕ1.0 mm, ϕ0.8 mm, ϕ0.6 mm and ϕ0.4 mm, the leakage of the ion beam is gradually reduced, and is reduced to 5% or so for ϕ0.6 mm and ϕ0.4 mm. As apparent from FIG. 21, therefore, making the apertures of the accelerator grid smaller than the apertures of the screen grid reduces the electric field generated by the potential difference between the plasma and the decelerator grid, so that the leakage of the ion beam can be reduced.

Figure 22:
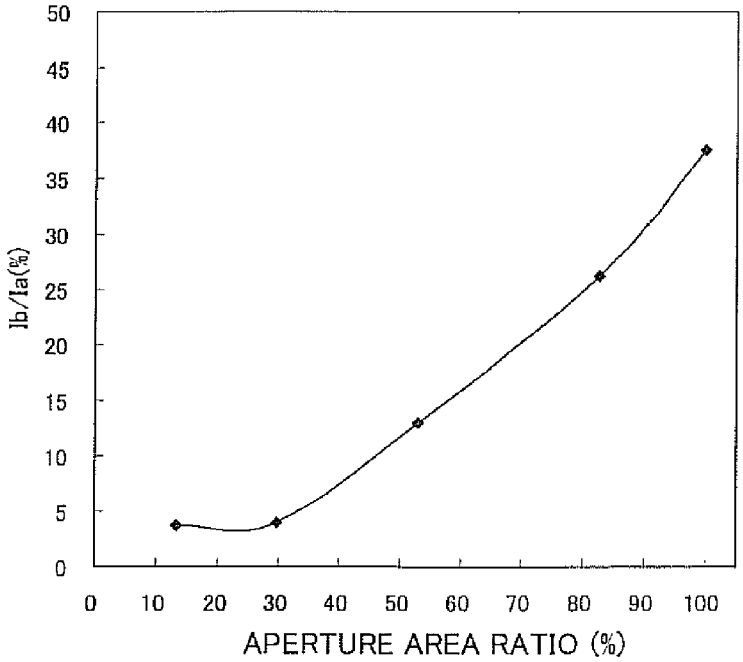
FIG. 22 is a graph showing the relationship of the ratio of ion beam intensities (Ib/Ia) v.s the area ratio of the grid aperture.

FIG. 22 shows the ratio of the ion current densities of the ion beams Ia and Ib under the condition that the voltage of the beam supply is 900 V, the current of the discharge power supply is 650 mA, the individual apertures 611, 613 of the screen grid 515 and the decelerator grid 517 are set to have a circular shape with a diameter of ϕ1.1 mm, and the individual apertures of the accelerator grids are set to have circular shapes with diameters of ϕ1.1 mm, ϕ1.0 mm, ϕ0.8 mm, ϕ0.6 mm and ϕ0.4 mm. The ion beam Ib is in an OFF state. In FIG. 22, the abscissa represents the ratio of the aperture area of the accelerator grid to the aperture area of the screen grid as an aperture area ratio, and the ordinate represents the ratio of the ion current density intensity Ib to the ion current density Ia (Ib/Ia).

It is apparent from FIG. 22 that Ib/Ia almost levels off at 5% or so at the ratio of the aperture area of the accelerator grid to the aperture area of the screen grid is 30% or less, Ib/Ia increases almost linearly when the ratio is over 30%, and Ib/Ia reaches 40% or so when the ratio becomes 100%. In a case of working on crystal resonators as in the embodiment, it is preferable that the ratio of the current density on the OFF side to the current density on the ON side be 25% or less so that a work target on that side where the ion beam is set off is not affected. It is therefore apparent from the graph shown in FIG. 22 that the diameter of the apertures of the accelerator grid 116 should be set to 80% or less with respect to the aperture area of the screen grid.

Figure 23:
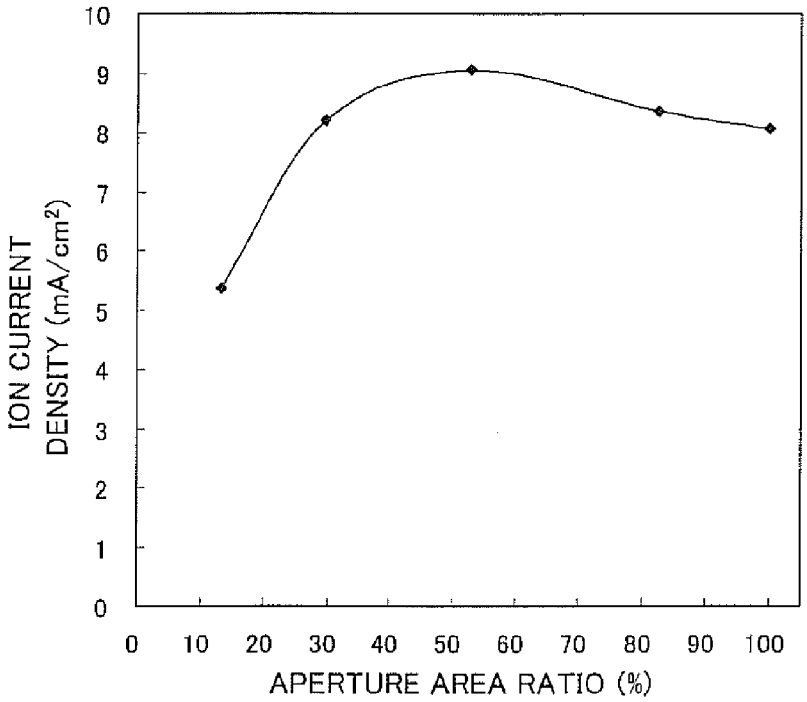
FIG. 23 is a graph showing the relationship of an ion beam intensity v.s. the area ratio of the grid aperture.

Next, FIG. 23 is a graph showing the current density when the ion beams Ia, Ib are both set on under the same conditions as those of the graph shown in FIG. 22. In FIG. 23, the area ratio of the apertures is taken on the abscissa, and the ion current density with Ia and Ib both set on is taken on the ordinate.

It is apparent from FIG. 23 that while the ion current density keeps 8 mA/cm$^2$ or higher until the area ratio of the apertures is 30%, the ion current density drops significantly when the area ratio becomes 20% or less. Particularly, under the condition of the voltage of the beam supply of 900 V, the ion current density practically needs to be 6 mA/cm$^2$ or higher, and falls below that value if the area ratio of the apertures is too small, causing a delay in the processing speed of the apparatus. To acquire a sufficient ion beam intensity, therefore, the area ratio of the apertures needs to be set 20% or greater.

While it is preferable to form the apertures of the accelerator grid small in order to acquire an effect of suppressing leakage of an ion beam, as apparent from the above, making the apertures too small reduces the intensity of the ion beam in an ON state. To suppress leakage in an OFF sate and secure the current intensity in an ON state, therefore, it is preferable that the area ratio of the apertures should be set to 0.2 to 0.8 times. Although the embodiment has been described in a case where the beam power supply voltage is 900 V, it is likewise preferable that the area ratio of the apertures should be set to 0.2 to 0.8 times for other power supply voltages to suppress leakage of the beam and secure the intensities of the ion beams.

In the frequency adjustment apparatus of the embodiment, as apparent from the above, as the apertures of the accelerator grid are formed smaller than the apertures of the screen grid, leakage of the ion beam on the OFF side can be suppressed without impairing the intensity of the ion current density on the ON side, so that a good ON/OFF characteristic of ion beams can be acquired.

Although the ion gun 11 which generates and irradiates two ion beams Ia, Ib has been described as an example in the embodiment, the number of ion beams irradiated by the ion gun is optional. The number is not limited to 2, 4, but may be optional or may be an odd number. The embodiment is not limited to the case where the ion beams are set on or off by setting the voltage applied to the separated accelerator grids on or off (floating), and the intensity of each ion beam may be changed continuously or stepwise (as shown in FIGS. 5 and 6) by controlling the voltage applied to each separated accelerator grid. When a plurality of devices are simultaneously adjusted with the same ion gun, the frequency adjustment rate can be change device by device.

Although the group of apertures formed in the accelerator grid corresponds to the group of apertures formed in the screen grid, and all the apertures of the accelerator grid are made smaller than the corresponding apertures of the screen grid in the embodiment, at least one of the apertures of the accelerator grid has only to be smaller than the corresponding aperture of the screen grid. For example, the apertures of the accelerator grid may be formed smaller than the apertures of the screen grid only at the center portion of the aperture group and the apertures of the accelerator grid are set equal to those of the screen grid at the peripheral portion of the group of apertures.

The present invention is not limited to the embodiments, can be modified and adapted in various forms. For example, while the foregoing descriptions of the embodiments of the present invention have been given of an adjustment apparatus which adjusts (changes) the resonance frequency of a crystal resonator by etching the metal electrode thereof by way of example, the etching and adjusting target is optional. For example, the present invention can be adapted to a case of etching the electrode of a piezoelectric device other than a crystal resonator. Further, the etching target or the material therefor are optional; for example, a metal, semiconductor, resin, etc. can be etched.

Although Ar ions are used as sputtering ions in the embodiments, other ions can of course be used. Further, ions are not restrictive, and the embodiments can be applied to electrons.

Although the foregoing description of each embodiment has been given of an example where a group of apertures consists of multiple holes, the embodiments are feasible with a single hole. The planar shape of each aperture is not limited to a circular shape, but may be elliptical or polygonal.

According to the present invention, a charged particle beam can be controlled by controlling a voltage to be applied to each separated accelerator grid.

This application is based on and claims the benefit of priority from Japanese Patent Application No. 2006-320764, filed on Nov. 28, 2006, and includes the specification, claims, drawings and the abstract. The disclosed contents of the Japanese patent application are incorporated herein by reference.

What is claimed is:

1. A charged particle beam apparatus for irradiating charged particles, comprising:

charged particle generating means that generates charged particles;

an accelerator grid having multi-separated accelerator grids that draw the charged particles generated by the charged particle generating means and output charged particle beams;

a screen grid provided between the charged particle generating means and the accelerator grid; and control means that controls each potential of the multi-separated accelerator grids to thereby independently control the respective charged particle beams.

2. The charged particle beam apparatus according to claim 1, wherein the control means independently controls the multi-separated accelerator grids to a floating potential to thereby block the respective charged particle beams.

3. The charged particle beam apparatus according to claim 1, wherein the control means includes switch circuits respectively provided between the individual multi-separated accelerator grids and a power supply, and means for individually setting the switch circuits on or off.

4. The charged particle beam apparatus according to claim 1, further comprising arrangement means that disposes a workpiece to be processed by irradiation of the charged particle beams, and wherein groups of apertures is formed in the accelerator grid, and a pitch of the groups of apertures disposed in the accelerator grid is set 0.5 to 1.0 times an arrangement interval of workpieces disposed by the arrangement means.

5. A frequency adjustment apparatus comprising:

an ion gun comprising the charged particle beam apparatus as recited in claim 1;

arrangement means that disposes a plurality of piezoelectric devices; and resonance frequency discrimination means that discriminates resonance frequencies of a plurality of piezoelectric devices disposed by the arrangement means, whereby while the resonance frequencies of the plurality of piezoelectric devices disposed by the arrangement means are monitored, an ion beam is irradiated to the plurality of piezoelectric devices to etch at least a part of each piezoelectric device, thereby adjusting the resonance frequencies of the plurality of piezoelectric devices.

6. The charged particle beam apparatus according to claim 1, wherein a group of apertures having a plurality of apertures is formed in the accelerator grid and the screen grid, and an area of at least one of the apertures formed in the accelerator grid is smaller area than an area of a corresponding one of the apertures formed in the screen grid.

7. The charged particle beam apparatus according to claim 6, wherein the area of the at least one accelerator grid aperture of the accelerator grid is 0.2 to 0.8 times the area of the screen grid apertures of the screen grid.

8. The charged particle beam apparatus according to claim 1, comprising a conductive shield plate for shielding an electric field generated between the multi-separated accelerator grids.

9. The charged particle beam apparatus according to claim 8, wherein the shield plate comprises a decelerator grid disposed on an output side of the accelerator grid from which the charged particle beams are output.

10. The charged particle beam apparatus according to claim 9, wherein the decelerator grid has a ground potential.

11. The charged particle beam apparatus according to claim 1, wherein an accelerator grid aperture formed in the accelerator grid is formed to have a smaller area than an area of a screen grid aperture formed in the screen grid.

12. The charged particle beam apparatus according to claim 11, wherein the area of the accelerator grid aperture of the accelerator grid is 0.2 to 0.8 times the area of a screen grid aperture formed in the screen grid.

13. The charged particle beam apparatus according to claim 12, further comprising a decelerator grid disposed on an output side of the accelerator grid from which the charged particle beams are output.

14. A method for controlling charged particles, comprising:

generating plasma in a predetermined container;

disposing a plurality of accelerator grids adjacent to the plasma;

applying a voltage to each accelerator grid to form a voltage gradient in a direction of drawing charged particles, and ejecting the charged particles in the plasma; and independently controlling voltages to the plurality of accelerator grids to thereby control a current density distribution of the ejected charged particles.

* * * * *